US005674831A

United States Patent [19]

Schulz et al.

[11] Patent Number: 5,674,831

[45] Date of Patent: Oct. 7, 1997

[54] METHOD OF MAKING UREA-BASED SOLID CLEANING COMPOSITIONS

[75] Inventors: Rhonda Kay Schulz, Eagan; Roger C. Zillmer, Apple Valley; Helen B. Bailly, Eagan, all of Minn.

[73] Assignee: Ecolab Inc., St. Paul, Minn.

[21] Appl. No.: 435,849

[22] Filed: May 4, 1995

Related U.S. Application Data

[62] Division of Ser. No. 421,476, Apr. 12, 1995, which is a continuation of Ser. No. 175,950, Dec. 30, 1993, abandoned.

[51] Int. Cl.[6] ..... C11D 1/50; C11D 13/10; C11D 13/16

[52] U.S. Cl. ..... 510/501; 510/445; 510/224; 510/218; 510/192

[58] Field of Search ..... 252/544, 174, 252/DIG. 16; 137/268; 510/224, 218, 192, 445, 501

[56] References Cited

U.S. PATENT DOCUMENTS

| | | | |
|---|---|---|---|
| Re. 32,763 | 10/1988 | Fernholz et al. | 252/90 |
| Re. 32,818 | 1/1989 | Fernholz et al. | 252/90 |
| 2,559,583 | 7/1951 | Barker | 252/152 |
| 2,559,584 | 7/1951 | Barker | 252/152 |
| 2,584,056 | 1/1952 | Soule et al. | 252/106 |
| 2,584,057 | 1/1952 | Soule et al. | 252/106 |
| 2,665,256 | 1/1954 | Barker | 252/152 |
| 2,824,091 | 2/1958 | Desty et al. | 260/96.5 |
| 2,927,900 | 3/1960 | Shiraeff | 252/152 |
| 3,046,232 | 7/1962 | Bonewitz | 252/156 |
| 3,324,038 | 6/1967 | Chaffee | 252/152 |
| 3,390,093 | 6/1968 | Feierstein et al. | 252/138 |
| 3,554,915 | 1/1971 | Keay et al. | 252/99 |
| 3,639,286 | 2/1972 | Ballestra et al. | 252/109 |
| 3,803,285 | 4/1974 | Jensen | 264/143 |
| 3,858,854 | 1/1975 | Win et al. | 252/89 |
| 4,119,578 | 10/1978 | Daeninckx et al. | 252/548 |
| 4,219,436 | 8/1980 | Gromer et al. | 252/135 |
| 4,273,684 | 6/1981 | Nagashima et al. | 252/544 |
| 4,289,525 | 9/1981 | Pasarela et al. | 71/92 |
| 4,427,558 | 1/1984 | David | 252/8.8 |
| 4,541,831 | 9/1985 | Gunther et al. | 8/648 |
| 4,587,029 | 5/1986 | Brooks | 252/91 |
| 4,587,031 | 5/1986 | Kruse et al. | 252/135 |
| 4,595,520 | 6/1986 | Heile et al. | 252/160 |
| 4,615,819 | 10/1986 | Leng et al. | 252/110 |
| 4,624,713 | 11/1986 | Morganson et al. | 134/25.2 |
| 4,680,134 | 7/1987 | Heile et al. | 252/160 |
| 4,695,284 | 9/1987 | Hight | 8/137 |
| 4,722,802 | 2/1988 | Hutchings et al. | 252/174 |
| 4,725,376 | 2/1988 | Copeland | 252/90 |
| 4,753,755 | 6/1988 | Gansser | 252/527 |
| 4,846,989 | 7/1989 | Killa | 252/99 |
| 4,933,100 | 6/1990 | Ramachandran | 252/95 |
| 5,061,392 | 10/1991 | Bruegge et al. | 252/135 |
| 5,066,425 | 11/1991 | Ofosu-Aasante et al. | 252/546 |
| 5,223,179 | 6/1993 | Connor et al. | 252/548 |
| 5,310,549 | 5/1994 | Bull | 424/78.08 |
| 5,338,491 | 8/1994 | Connor et al. | 252/548 |
| 5,397,506 | 3/1995 | Groth et al. | 252/547 |
| 5,474,698 | 12/1995 | Rolando et al. | 252/90 |

FOREIGN PATENT DOCUMENTS

| | | |
|---|---|---|
| 0 178 131 | 10/1985 | European Pat. Off. . |
| 56-76499 | 6/1981 | Japan . |
| 56-76500 | 6/1981 | Japan . |
| 58-168695 | 10/1983 | Japan . |
| 61-87800 | 5/1986 | Japan . |

*Primary Examiner*—Paul Lieberman
*Assistant Examiner*—Charles Boyer
*Attorney, Agent, or Firm*—Merchant, Gould, Smith, Edell, Welter & Schmidt, P.A.

[57] ABSTRACT

The invention provides a process for preparing a homogeneous, urea-based, solid cleaning composition, without the application of heat from an external source to melt the urea. Cleaning compositions for use in warewashing and cleaning hard surfaces, rinsing, sanitizing, deodorizing, and the like, made by the method are also provided. Preferably, the ingredients are processed in an extruder, and the mixture is extruded directly into a mold or other packaging system for dispensing the detergent. The consistency of the composition ranges from that of a fused solid block to a malleable article.

5 Claims, No Drawings

METHOD OF MAKING UREA-BASED SOLID CLEANING COMPOSITIONS

This is a Divisional of application Ser. No. 08/421,476, filed Apr. 12, 1995, which is a Continuation of application Ser. No. 08/175,950, filed Dec. 30, 1993, now abandoned which applications are incorporated herein by reference.

FIELD OF THE INVENTION

The invention is directed to a process for manufacturing homogeneous, solid cleaning compositions comprising urea as a hardening agent, as for example, ware and/or hard surface cleaning compositions, rinse aids, sanitizing additives, deodorant blocks, and the like. The urea-based cleaning compositions are processed at reduced temperatures without a molten phase to melt the ingredients. The cleaning compositions are preferably prepared in a continuous mixing system, most preferably an extruder.

BACKGROUND OF THE INVENTION

The development of solid block cleaning compositions has revolutionized the manner in which detergent compositions are dispensed by commercial and institutional entities that routinely use large quantities of cleaning materials. Solid block compositions offer unique advantages over the conventional liquids, granules or pellet forms of detergents, including improved handling, enhanced safety, elimination of component segregation during transportation and storage, and increased concentrations of active components within the composition. Because of these benefits, solid block cleaning compositions, such as those disclosed in U.S. Pat. Nos. RE 32,763, RE 32,818, 4,680,134 and 4,595,520, have quickly replaced the conventional composition forms in commercial and institutional-markets.

Urea has been used in cleaning and sanitizing compositions as a hardener and solubility modifier, as described for example in U.S. Pat. No. 4,624,713 to Morganson et al. (issued Nov. 25, 1986), and in J. A. Melin, Encapsulation and Solidification of Nonionic Surfactants by Reaction with Urea, File No. 1253, Series 15f, Report 1, Economics Laboratory, Inc., St. Paul, Minn. (Apr. 11, 1967). It is believed that urea will react with an organic compound to form a crystalline adduct, or "inclusion compound," in which urea molecules are wrapped around the molecules of the organic compound in a spiral or helical formation. To achieve this physical arrangement, the organic compound must have a structure or stereochemistry that will allow it to fit within the spiral of the urea molecules and facilitate occlusion by or with urea. In general, urea will form inclusion compounds with long straight-chain molecules of six or more carbons but not with branched or bulky molecules.

To manufacture a solid block urea-based composition, the urea is combined with the ingredients under melting temperatures, commonly referred to as a "molten process," to achieve a homogeneous mixture. The melt is then poured into a mold and cooled to a solid form. For example, U.S. Pat. No. 4,624,713 to Morganson et al. discloses a solid rinse aid formed from a urea occlusion composition that comprises urea and a compatible surfactant, namely a polyoxypropylene or polyoxyethylene glycol compound. The solid rinse aids are prepared by mixing the ingredients in a steam jacketed mixing vessel under melting temperatures and under pressurized steam, heating the mixture to about 220° F., cooling the mixture to about 180° F., pouring the cooled mixture into a plastic container, allowing the mixture to solidify by cooling to room temperature (about 15°–32° C.), and allowing the product to cure or harden for about 2–4 days.

Solid block cleaning and sanitizing compositions and rinse aids provide a significant improvement over the conventional liquid, granular and pelletized cleaning compositions. Although, the molten process is useful for preparing solid block compositions, time and expense would be saved if heating and cooling of the composition could be eliminated from the process, and higher viscosities could be used. Also, lower process temperatures would facilitate use of heat-sensitive ingredients in cleaning compositions. In addition, less sturdy packaging would be required if the processed mixture could be dispensed at a lower temperature.

Therefore, an object of the invention is to provide a process for manufacturing a solid cleaning composition comprising a urea hardening agent at a process temperature below the melt temperature of the urea and active ingredients. Another object is to provide a method for making a urea-based cleaning composition under ambient temperatures. Yet another object is to provide a continuous feed extrusion process for making urea-based cleaning compositions that include in-line milling of the urea to a desired particle size.

SUMMARY OF THE INVENTION

The invention is directed to a process for preparing a homogeneous, solid cleaning composition comprising a urea hardening agent and a cleaning agent, in which no or minimal heat is applied from an external source. Cleaning compositions which may be manufactured according to the invention include, for example, compositions for use in warewashing and cleaning hard surfaces, rinsing, sanitizing, deodorizing, and the like.

The method of making a solid, urea-based cleaning composition according to the invention includes the steps of (a) mixing together in a continuous mixing system at high shear, an effective hardening amount of urea and an effective amount of a cleaning agent, optionally in a minor but effective amount of an aqueous medium, to form a substantially homogeneous mixture, (b) discharging the mixture from the mixing system; and (c) allowing the mixture to harden to a solid composition. The amount of the aqueous medium in the mixture is effective to solubilize the urea, if needed, in the mixture, and to dilute the mixture as desired.

The invention provides a process for manufacturing a homogeneous, urea-based cleaning composition under ambient processing temperatures of about 30°–50° C., without the need to apply heat to the mixture from an external source to melt the urea and other ingredients to a molten phase. It is preferred that the processing temperature of the mixture is about 0.5°–50° C. below, preferably about 20°–50° C. below the melting point of the urea. The operating temperature may be below the melting point of all or some of the other ingredients. Optionally, a minimal but effective amount of heat may be applied to the mixture from an external source to facilitate processing, for example, during the mixing phase to maintain the mixture at an effective viscosity.

The ingredients are processed in a continuous processing system capable of mixing the ingredients together at high shear to provide a homogenous mixture, and of retarding solidification to maintain the mixture as a flowable mass during processing. Continuous mixing systems useful according to the invention include a continuous flow mixer, or more preferably a single- or twin-screw extruder, a twin-screw extruder being highly preferred.

A variety of urea-based cleaning compositions may be produced according to the present method. The types and amounts of ingredients that comprise a particular composition will vary according to its purpose and use. The composition will comprise an effective cleaning amount of a cleaning agent, and optional other ingredients as desired. The cleaning agent is preferably a surfactant or surfactant system, and may be added separately to the mixture or as part of a premix with another ingredient such as a secondary cleaning agent, a sequestering agent, an alkaline source, a bleaching-agent, a deodorizing agent, a de-foaming agent, and the like. The ingredients may be in the form of a solid such as a dry particulate, or a liquid. An ingredient may be included separately or as part of a premix with another ingredient. One or more premixes may be used, and may include part or all of an ingredient.

The urea is of a particle size effective to combine with the cleaning agent and optional other ingredients to form a homogeneous mixture with no or a minimal amount of heat applied from an external source. The urea may be milled to a suitable particle size. Although a mill separate from the mixer may be used, an in-line mill is preferred to provide continuous processing of the mixture. In a preferred embodiment of the invention, the mixing system is an extruder, preferably a twin-screw extruder, and the particle size Of the urea is reduced by the shearing action of the rotating screws in the extruder.

After processing, the mixture is discharged from the mixer, as for example, by casting or extruding. The composition is then allowed to harden to a solid form. Advantageously, due to the "cold processing" of the ingredients, the mixture may be cast or extruded directly into a packaging wrapper or casing, or into a mold that may also serve as a dispenser for the composition during use. Preferably, the processed composition "sets up" to a solid form within about 1 minute to about 3 hours, preferably about 5 minutes to about 1 hour, of being discharged from the mixer. Preferably, complete solidification or equilibrium of the processed composition is within about 1–48 hours of being discharged from the mixer, preferably within about 1–36 hours, preferably within about 1–24 hours. Solidification of the composition is substantially simultaneous throughout its mass, and without significant post-solidification swelling.

By the term "solid" as used to describe the processed composition, it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition may range from that of a fused solid block which is relatively dense and hard, for example, like concrete, to a consistency characterized as being malleable and sponge-like, similar to caulking material.

Advantageously, with the present method, a homogeneous, solid cleaning composition may be processed at a temperature lower than that typically used in other methods in which the urea is melted with the other ingredients to form a solid composition. Since melt temperatures are not required, problems with de-activation of thermally-sensitive ingredients in the composition may be avoided. In addition, due to the lower temperatures used in the processing, little or no cooling of the mixture is required prior to being cast or extruded, for example, into a packaging wrapper, casing, mold, dispenser, and the like. The use of lower temperatures also broadens the options of packaging materials that may be used to contain the processed composition.

In addition, hardening of the cleaning composition after processing is accelerated since the end-process temperature of the composition is closer to that required for solidification. The rapid solidification achieved by the present method speeds production of the solid product, and minimizes segregation of the ingredients of the composition, for example by trapping non-compatible ingredients in a matrix of suitably high viscosity and a low temperature to prevent segregation. Also, the use of an extruder provides continuous processing of a cleaning composition, easy clean-up, and a high level of control and repeatability of the formulation process, among other advantages. Further, a multi-chamber extruder provides segregated chambers for sequential processing of the cleaning composition.

DETAILED DESCRIPTION OF THE INVENTION

The present invention provides a process for manufacturing a variety of solid cleaning compositions that comprise urea as a hardening or solidifying agent, at below the melt temperature of the urea, that is, under "cold processing" conditions. Urea-based cleaning compositions that may be prepared according to the method of the invention include, for example, ware and/or hard surface cleaning compositions, rinse aids, sanitizing additives, deodorant blocks, and the like.

The compositions are produced using a continuous mixing system, preferably a single- or twin-screw extruder, by combining and mixing a source of urea with one or more cleaning agents and optional other ingredients, such as a minor but effective amount of water, at high shear to form a homogeneous mixture. The processed mixture may be dispensed from the mixing system, by extruding, casting or other suitable means, whereupon the composition hardens to a solid form which ranges in consistency from a solid block to a malleable, spongy, self-supporting form such as a coil, square or other shape. Variations in processing parameters may be used to control the development of crystal size and crystalline structure of the matrix and thus the texture of the final product. For example, continuing to shear the mixture while solidification is in progress will create a smaller crystal and a pasty product. The structure of the matrix may be characterized according to its hardness, melting point, material distribution, crystal structure, and other like properties according to known methods in the art. A cleaning composition processed according to the method of the invention is substantially homogeneous with regard to the distribution of ingredients throughout its mass, and also substantially deformation-free.

Unless otherwise specified, the term "wt-%" is the weight of an ingredient based upon the total weight of the composition.

Urea Hardening Agent

The solidification rate of the compositions made according to the invention will vary, at least in part, according to the amount, and the particle size and shape of the urea added to the composition. In the method of the invention, a particulate form of urea is combined with a cleaning agent and optional other ingredients, preferably a minor but effective amount of water. The amount and particle size of the urea is effective to combine with the cleaning agent and other ingredients to form a homogeneous mixture without the application of heat from an external source to melt the urea and other ingredients to a molten stage. It is also preferred that the urea will form a matrix with the cleaning agent and other ingredients which will hardens to a solid under ambient temperatures of about 30°–50° C. preferably about 35°–45° C., after the mixture is discharged from the mixing system, within about 2 minutes to about 3 hours, preferably about 5 minutes to about 2 hours, preferably about 10 minutes to about 1 hour. A minimal amount of heat from an external source may be applied to the mixture to facilitate processing of the mixture. It is preferred that the amount of urea included in the composition is effective to provide a hardness and desired rate of solubility of the composition when placed in an aqueous medium to achieve a desired rate of dispensing the cleaning agent from the solidified composition during use. Preferably, the composition includes about 5–90 wt-% urea, preferably about 8–40 wt-%, preferably about 10–30 wt-%.

The urea may be in the form of prilled beads or powder. Prilled urea is generally available from commercial sources as a mixture of particle sizes ranging from about 8–15 U.S. mesh, as for example, from Arcadian Sohio Company, Nitrogen Chemicals Division. A prilled form of urea is preferably milled to reduce the particle size to about 50 U.S. mesh to about 125 U.S. mesh, preferably about 75–100 U.S. mesh, preferably using a wet mill such as a single or twin-screw extruder, a Teledyne mixer, a Ross emulsifier, and the like.

Aqueous Medium

The ingredients may optionally be processed in a minor but effective amount of an aqueous medium such as water to solubilize the urea and other ingredients and achieve a homogenous mixture, to aid in the urea occlusion reaction, to provide an effective level of viscosity for processing the mixture, and to provide the processed composition with the desired amount of firmness and cohesion during discharge and upon hardening. It is preferred that the mixture during processing comprises about 2–15 wt-% of an aqueous medium, preferably about 3–5 wt-%. Preferably, the ratio of water to urea in the mixture is about 0.5:3 to about 1:6, preferably about 1:3 to about 1:5, preferably about 1:4. Preferably, the composition upon being discharged from the mixture includes about 2–5 wt-% water, preferably about 3–5 wt-%.

Active Ingredients

The present method is suitable for preparing a variety of solid cleaning compositions, as for example, detergent compositions, sanitizing compositions, conveyor lubricants, floor cleaners, rinse aid compositions, deodorant blocks, and the like. The cleaning compositions of the invention comprise conventional active ingredients that will vary according to the type of composition being manufactured.

A urea-based detergent composition for removing soils and stains may include, for example, a major amount of a surfactant or surfactant system such as a polyoxyethylene-polyoxypropylene condensate or a quaternary ammonium chloride surfactant, and minor but effective amounts of other ingredients such as a chelating agent/sequestrant such as ethylenediaminetetraacetic acid (EDTA) or sodium tripolyphosphate, an alkali such as an alkali metal hydroxide or a metal silicate, a bleaching agent such as sodium hypochlorite or hydrogen peroxide, an enzyme such as a protease or an amylase, and the like.

To form a urea-based composition according to the invention, it is preferred that the active ingredients have a molecular structure that will allow the formation of an "inclusion compound" with the urea molecule. See, for example, U.S. Pat. No. 4,624,713 to Morganson et al.; and J. A. Melin, Encapsulation and Solidification of Nonionic Surfactants by Reaction with Urea, File No. 1253, Series 15f, Report 1, Economics. Laboratory, Inc., St. Paul, Minn. (Apr. 11, 1967), the disclosures of which are incorporated by reference herein.

Cleaning Agents

The composition comprises at least one cleaning agent which is preferably a surfactant or surfactant system. A variety of surfactants can be used in a cleaning composition, including anionic, cationic, nonionic and zwitterionic surfactants, which are commercially available from a number of sources. For a discussion of surfactants, see Kirk-Other, *Encyclopedia of Chemical Technology*, Third Edition, volume 8, pages 900–912. Preferably, the cleaning composition comprises a cleaning agent in an amount effective to provide a desired level of cleaning, preferably about 30–95 wt-%, more preferably about 50–85 wt-%.

Anionic surfactants useful in the present urea-based cleaning compositions, include, for example, carboxylates such as alkylcarboxylates and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, and fatty alcohol sulfates.

Nonionic surfactants useful in cleaning compositions, include those having a polyalkylene oxide polymer as a portion of the surfactant molecule. Such nonionic surfactants include, for example, alcohol alkoxylates such as alcohol ethoxylate propoxylates, alcohol propoxylates, alcohol propoxylate ethyoxylate propoxylates, alcohol ethoxylate butoxylates, and the like, and alkyl-capped alcohol alkoxylates; polyoxyethylene glycol ethers of fatty alcohol such as Ceteareth-27 or Pareth 25-7, and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2 -imidazoline, and the like; and quaternary ammonium salts, as for example, alkylquaternary ammonium chloride surfactants such as n-alkyl ($C_{12}$–$C_{18}$)dimethylbenzyl ammonium chloride, n-tetradecyldimethylbenzylammonium chloride monohydrate, a napthylene-substituted quaternary ammonium chloride such as dimethyl-1-napthylmethylammonium chloride, and the like; and other like cationic surfactants.

Also useful are zwitterionic surfactants such as β-N-alkylaminopropionic acids, N-Alkyl-β-iminodipropionic acids, imidazoline carboxylates, N-alkylbetaines, sultaines, and the like.

Other Additives

Urea-based compositions made according to the invention may further include conventional additives such as a chelating/sequestering agent, bleaching agent, alkaline source, secondary hardening agent or solubility modifier, detergent filler, defoamer, anti-redeposition agent, a threshold agent or system, aesthetic enhancing agent (i.e., dye, perfume), and the like. Adjuvants and other additive ingredients will vary according to the type of composition being manufactured.

Chelating/Sequestering Agents

The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. Preferably, a cleaning composition includes about 0.1–70 wt-%, preferably from about 5–50 wt-%, of a chelating/sequestering agent.

Useful aminocarboxylic acids include, for example, n-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as aminotris(methylene phosphonic acid), hydroxyethylidene diphosphonic acid, ethylenediaminetetrae(methylene phosphonic acid), diethylenetriaminepente(methylene phosphonic acid), and the like. It is preferred to use a neutralized or alkaline phosphonate, or to combine the phosphonate with an alkali source prior to being added into the mixture such that there is little or no heat generated by a neutralization reaction when the phosphate is added.

Polyacrylates suitable for use as cleaning agents include, for example, polyacrylic acid, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology*, Third Edition, volume 5, pages 339–366 and volume 23, pages 319–320, the disclosure of which is incorporated by reference herein.

Bleaching Agents

Bleaching agents for use in a cleaning compositions for lightening or whitening a substrate, include bleaching compounds capable of liberating an active halogen species, such as —Cl, —Br, —OCl and/or —OBr, under conditions typically encountered during the cleansing process. Suitable bleaching agents for use in the present cleaning compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorides, monochloramine and dichloramine, and the like. Encapsulated chlorine sources may also be used to enhance the stability of the chlorine source in the composition (see, for example, U.S. Pat. No. 4,618,914, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1–10 wt-%, preferably about 1–6 wt-%.

Alkaline Sources

The cleaning composition produced according to the invention may include minor but effective amounts of one or more alkaline sources to enhance cleaning of a substrate and improve soil removal performance of the composition. It can be appreciated that a caustic matrix has a tenancy to solidify due to the activity of an alkaline source in, fixing the free water present in a composition as water of hydration. Premature hardening of the composition may interfere with mixing of the active ingredients with the urea hardening agent to form a homogeneous mixture, and/or with casting or extrusion of the processed composition. Accordingly, an alkali metal hydroxide or other alkaline source is preferably included in the cleaning composition in an amount effective to provide the desired level of cleaning action yet avoid premature solidification of the composition by the reaction of the caustic material with the other ingredients. However, it can be appreciated that an alkali metal hydroxide or other hydratable alkaline source can assist to a limited extent, in solidification of the composition. It is preferred that the composition comprises about 0.1–70 wt-% of an alkaline source, preferably about 10–50 wt-%.

Suitable alkali metal hydroxides include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled beads having a mix of particle sizes ranging from about 12–100 U.S. mesh, or as an aqueous solution, as for example, as a 50 wt-% and a 73 wt-% solution. It is preferred that the alkali metal hydroxide is added in the form of an aqueous solution, preferably a 50 wt-% hydroxide solution, to reduce the amount of heat generated in the composition due to hydration of the solid alkali material.

A cleaning composition may comprise a secondary alkaline source other than an alkali metal hydroxide. Examples of useful secondary alkaline sources include a metal silicate such as sodium or potassium silicate or metasilicate, a metal carbonate such as sodium or potassium carbonate, bicarbonate, sesquicarbonate, and the like; a metal borate such as sodium or potassium borate, and the like; ethanolamines and amines; and other like alkaline sources. Secondary alkalinity agents are commonly available in either aqueous or powdered form, either of which is useful in formulating the present cleaning compositions. The composition may include a secondary alkaline source in an amount of about 1–30 wt-%, preferably about 10–20 wt-%.

Secondary Hardening Agents/Solubility Modifiers

The present compositions may include a minor but effective amount of a secondary hardening agent, as for example, an amide such stearic monoethanolamide or lauric diethanolamide, or an alkylamide, and the like; a solid polyethylene glycol or a propylene glycol, and the like; starches that have been made water-soluble through an acid or alkaline treatment process; various inorganics that impart solidifying properties to a heated composition upon cooling, and the like. Such compounds may also vary the solubility of the composition in an aqueous medium during use such that the cleaning agent and/or other active ingredients may be dispensed from the solid composition over an extended period of time. The composition may include a secondary hardening agent in an amount of about 5–20 wt-%, preferably about 10–15 wt-%.

Detergent Fillers

A cleaning composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, alkylene glycols such as propylene glycol, and the like. Preferably, a detergent filler is included in an amount of about 1–20 wt-%, preferably about 3–15 wt-%.

Defoaming Agents

A minor but effective amount of a defoaming agent for reducing the stability of foam may also be included in the present urea-based cleaning compositions. Preferably, the cleaning composition includes about 0.0001–5 wt-% of a defoaming agent, preferably about 0.01–1 wt-%.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-redeposition Agents

A cleaning composition may also include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A cleaning composition may include about 0.5–10 wt-%, preferably about 1–5 wt-%, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Processing of the Composition

The invention provides a method of processing a urea-based cleaning composition without the need for applying heat to the system from an external source to melt the urea and other ingredients to a molten state. According to the invention, a cleaning agent and optional other ingredients are mixed at high shear with an effective solidifying amount of urea optionally in an aqueous medium. It is understood that although a minimal amount of heat may be applied from an external source to facilitate processing of the mixture, the amount of heat is not effective to melt the urea in the mixture.

Although not intended to limit the scope of the invention, it is believed that, at least in part, the continuous mixing of the ingredients of the cleaning composition at high shear enables the composition to be processed at a significantly lower temperature than that needed in other processing methods in which the ingredients of the composition are melted to form a homogenous mixture. It is also believed that, at least in part, the addition of a small particle-sized urea to an aqueous solution containing active ingredients, enables the mixture to be processed at a temperature of about 30°–50° C., which is about 10°–40° C. lower than the temperature at which the composition begins to solidify. Since the urea-based mixture is thermodynamically unstable, the mixture will tend to gain heat to achieve thermodynamic equilibrium, and will eventually solidify resulting in a thermodynamically stable composition.

The mixing system provides for continuous mixing of the ingredients at high shear to form a substantially homogeneous liquid or semi-solid mixture in which the ingredients are distributed throughout its mass. Preferably, the mixing system includes means for mixing the ingredients to provide shear effective for maintaining the mixture at a flowable consistency, with a viscosity during processing of about 1,000–1,000,000 cps, preferably about 5,000–200,000 cps. The mixing system is preferably a continuous flow mixer, as for example, a Teledyne continuous processor or a Breadsley Piper continuous mixer, more preferably a single or twin screw extruder apparatus, with a twin-screw extruder being highly preferred, as for example, a multiple section Buhler Miag twin screw extruder.

It is preferred that the mixture is processed at a temperature lower than the melting temperature of the urea, preferably at ambient temperatures of about 30°–50° C., more preferably about 35°–45° C. Although no or limited external heat may be applied to the mixture, it can be appreciated that the temperature achieved by the mixture may become elevated during processing due to variances in ambient conditions, and/or by an exothermic reaction between ingredients. Optionally, the temperature of the mixture may be increased, for example, at the inlets or outlets of the mixing system, by applying heat from an external source to achieve a temperature of about 50°–150° C., preferably about 55°–70° C., to facilitate processing of the mixture.

In general, the composition is processed at a pressure of about 5–150 psig, preferably about 10–30 psig. The pressure may be increased to about 160–2,000 psig to maintain fluidity of the mixture during processing, to provide a force effective to urge the mixture through the mixer and the discharge port, and the like.

Optionally, but preferably, the mixing system includes means for milling the urea, such as a prilled urea, to a desired particle size. The urea may be milled separately prior to being added to the mixture, or with another ingredient.

Preferably, the urea is wet milled by means of an in-line wet mill, as for example, a twin-screw extruder, a Teledyne mixer, a Ross emulsifier, and the like. Preferably, the urea is milled to a particle size effective for the urea to combine with the cleaning agent and optional other ingredients to form a homogeneous mixture without heat applied from an external source. Preferably, the particle size of the urea in the mixture is about 50–125 U.S. mesh, more preferably about 75–100 U.S. mesh.

An ingredient may be in the form of a liquid or a solid such as a dry particulate, and may be added to the mixture separately or as part of a premix with another ingredient, as for example, the cleaning agent, the urea, the aqueous medium, and additional ingredients such as a second cleaning agent, a detergent adjuvant or other additive, a secondary hardening agent, and the like. One or more premixes may be added to the mixture.

An aqueous medium may be included in the mixture in a minor but effective amount to solubilize the urea, to maintain the mixture at a desired viscosity during processing, and to provide the processed composition and final product with a desired amount of firmness and cohesion. The aqueous medium may be included in the mixture as a separate ingredient, or as part of a liquid ingredient or premix.

The ingredients are mixed together at high shear to form a substantially homogeneous consistency wherein the ingredients are distributed substantially evenly throughout the mass. The mixture is then discharged from the mixing system by casting into a mold or other container, by extruding the mixture, and the like. Preferably, the mixture is cast or extruded into a mold or other packaging system which can optionally, but preferably, be used as a dispenser for the composition. It is preferred that the temperature of the mixture when discharged from the mixing system is sufficiently low to enable the mixture to be cast or extruded directly into a packaging system without first cooling the mixture. Preferably, the mixture at the point of discharge is at about ambient temperature, about 30°–50° C., preferably about 35°–45° C. The composition is then allowed to harden to a solid form that may range from a low density, sponge-like, malleable, caulky consistency to a high density, fused solid, concrete-like block.

In a preferred method according to the invention, the mixing system is a twin-screw extruder which houses two adjacent parallel rotating screws designed to co-rotate and intermesh, the extruder having multiple barrel sections and a discharge port through which the mixture is extruded. The extruder may include, for example, one or more feed or conveying sections for receiving and moving the ingredients, a compression section, mixing sections with varying temperature, pressure, shear and the like, a die section, and the like. Suitable twin-screw extruders can be obtained commercially and include for example, Buhler Miag Model No. 62mm, Buhler Miag, Plymouth, Minn. USA.

Extrusion conditions such as screw configuration, screw pitch, screw speed, temperature and pressure of the barrel sections, shear, throughput rate of the mixture, water content, die hole diameter, ingredient feed rate, and the like, may be varied as desired in a barrel section to achieve effective processing of ingredients to form a substantially homogeneous liquid or semi-solid mixture in which the ingredients are distributed evenly throughout. To facilitate processing of the mixture within the extruder, it is preferred that the viscosity of the mixture is maintained at about 1,000–100,000 cps, more preferably about 10,000–40,000 cps.

The extruder comprises a high shear screw configuration and screw conditions such as pitch, flight (forward or reverse) and speed effective to achieve high shear processing of the ingredients to a homogenous mixture. Preferably, the screw comprises a series of elements for conveying, mixing, kneading, compressing, discharging, and the like, arranged to mix the ingredients at high shear and convey the mixture through the extruder by the action of the screw within the barrel section. The screw element may be a conveyor-type screw, a paddle design, a metering screw, and the like. A preferred screw speed is about 20–250 rpm, preferably about 40–150 rpm. It is preferred that the extruder include a milling chamber with a suitable screw configuration for reducing a prilled form of urea with an average size of about 8–15 U.S. mesh to a particle size of about 50–125 U.S. mesh, preferably about 75–100 U.S. mesh.

Optionally, heating and cooling devices may be mounted adjacent the extruder to apply or remove heat in order to obtain a desired temperature profile in the extruder. For example, an external source of heat may be applied to one or more barrel sections of the extruder, such as the ingredient inlet section, the final outlet section, and the like, to increase fluidity of the mixture during processing through a section or from one section to another, or at the final barrel section through the discharge port. Preferably, the temperature of the mixture during processing, including at the discharge port, is maintained at or below the melting temperature of the urea and other ingredients.

In the extruder, the action of the rotating screw or screws will mix the ingredients and force the mixture through the sections of the extruder with considerable pressure. Pressure may be increased up to about 2,000 psig, preferably up to about 5–150 psig, in one or more barrel sections to maintain the mixture at a desired viscosity level or at the die to facilitate discharge of the mixture from the extruder.

The flow rate of the mixture through the extruder will vary according to the type of machine used. In general, a flow rate is maintained to achieve a residence time of the mixture within the extruder effective to provide substantially complete mixing of the ingredients to a homogenous mixture, and to maintain the mixture at a fluid consistency effective for continuous mixing and eventual extrusion from the mixture without premature hardening.

When processing of the ingredients is completed, the mixture may be discharged from the extruder through the discharge port, preferably a die. The pressure may also be increased at the discharge port to facilitate extrusion of the mixture, to alter the appearance of the extrudate, for example, to expand it, to make it smoother or grainier in texture as desired, and the like.

The cast or extruded composition eventually hardens due, at least in part, to cooling and/or the chemical reaction of the ingredients. The solidification process may last from a few minutes to about 2–3 hours, depending, for example, on the size of the cast or extruded composition, the ingredients of the composition, the temperature of the composition, and other like factors. Preferably, the cast or extruded composition "sets up" or begins to hardens to a solid form within about 1 minute to about 3 hours, preferably about 2 minutes to about 2 hours, preferably about 5 minutes to about 1 hour.

Packaging System

The processed compositions of the invention may be cast or extruded into temporary molds from which the solidified compositions may be removed and transferred for packaging. The compositions may also be cast or extruded directly into a packaging receptacle. Extruded material may also be cut to a desired size and packaged, or stored and packaged at a later time.

The packaging receptacle or container may be rigid or flexible, and composed of any material suitable for containing the compositions produced according to the invention, as for example, glass, steel, plastic, cardboard, cardboard composites, paper, and the like.

Advantageously, since the composition is processed at or near ambient temperatures, the temperature of the processed mixture is low enough so that the mixture may be cast or extruded directly into the container or other packaging receptacle without structurally damaging the receptacle material. As a result, a wider variety of materials may be used to manufacture the container than those used for compositions that processed and dispensed under molten conditions.

It is highly preferred that the packaging used to contain the compositions is manufactured from a material which is biodegradable and/or water-soluble during use. Such packaging is useful for providing controlled release and dispensing of the contained cleaning composition. Biodegradable materials useful for packaging the compositions of the invention include, for example, water-soluble polymeric films comprising polyvinyl alcohol, as disclosed for example in U.S. Pat. No. 4,474,976 to Yang; U.S. Pat. No. 4,692,494 to Sonenstein; U.S. Pat. No. 4,608,187 to Chang; U.S. Pat. No. 4,416,793 to Haq; U.S. Pat. No. 4,348,293 to Clarke; U.S. Pat. No. 4,289,815 to Lee; and U.S. Pat. No. 3,695,989 to Albert, the disclosures of which are incorporated by reference herein.

In addition, the mixture may be cast into a variety of shapes and sizes by extrusion since the viscosity of the mixture can be varied, for example, according to the amount of shear applied during mixing, the amount of urea and water included in the mixture, temperature of the mixture, and other like factors. Also, unlike the "molten process," since the mixture is processed at a relatively low temperature, minimal cooling of the composition is required prior to or after casting or extruding. The low temperature of the discharged material also enhances safety for those handling the material. In addition, the extruded or cast composition will harden substantially simultaneously throughout its mass when the mixture is discharged from the mixing system due to cooling and/or the chemical reaction of the urea with the ingredients of the composition.

Where the composition comprises a highly caustic material, safety measures should be taken during manufacture, storage, dispensing and packaging of the processed composition. In particular, steps should be taken to reduce the risk of direct contact between the operator and the solid cast composition, and the washing solution that comprises the composition.

Dispensing of the Processed Compositions

It is preferred that a cleaning composition made according to the present invention is dispensed from a spray-type dispenser such as that disclosed in U.S. Pat. Nos. 4,826,661, 4,690,305, 4,687,121, and 4,426,362, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use.

The invention will be further described by reference to the following detailed examples. These examples are not meant to limit the scope of the invention that has been set forth in the foregoing description. Variation within the concepts of the invention are apparent to those skilled in the art.

EXAMPLE 1

Urea-Based Cleaning Composition Containing a Cationic Surfactant Cleaning Agent A detergent composition was prepared for use in urinals to control odor and soil build-up.

The ingredients were processed in a five section, 62 mm, 100 HP, Buhler-Miag twin screw extruder. The first three sections of the extruder were configured for high shear and the last two sections for mixing and conveying.

The ingredients of the composition were as follows.

| INGREDIENT | MIXTURE (wt-%) |
|---|---|
| $C_{12}$–$C_{18}$ alkyl dimethylbenzyl ammonium chloride | 10.00 |
| Propylene glycol | 15.00 |
| Nonylphenol ethoxylate (EO = 150; Igepal DM-970) | 24.50 |
| Stearic monoethanolamide | 13.50 |
| Sodium tripolyphosphate, anhyd. powder | 5.97 |
| Urea | 25.00 |
| Morplas Blue N | 0.03 |
| Fragrance | 6.00 |

The quaternary ammonium chloride surfactant, propylene glycol, dye and fragrance made up a single liquid premix. The remaining materials constituted a dry powder premix.

The dry premix was fed into the first section of the extruder. The liquid mix was heated to 160° F. and fed into the fourth section of the extruder. Sections 1 and 2 were heated to 275° F., the exit temperature was 140° F., and the exit pressure was 100 psi.

The extruded material hardened to a chalk-like consistency in approximately one hour.

EXAMPLE 2

Urea-Based Cleaning Composition Containing a Nonionic Surfactant Cleaning Agent A rinse composition for use in the final rinse of a low temperature commercial dishwashing machine was prepared as described hereinabove in Example 1, except as noted below.

| INGREDIENT | MIXTURE (wt-%) |
|---|---|
| Ethylene Oxide/Propylene Oxide (EO/PO = 35/65) (M.W. 2500–2900) | 84.48 |
| Urea | 12.00 |
| Soft water | 3.50 |
| Direct Blue 86 dye (Mobay; PA) | 0.02 |

The surfactant, water, and dye made up a single liquid premix. The urea constituted the only dry feed.

The urea was fed into the first section of the extruder. The liquid premix was fed into section 4. Sections 1 and 2 were heated to 150° F., the exit temperature was 60° F., and the exit pressure was 75 psi. The product was filled into polyethylene containers.

The extruded material hardened to a firm block that could be removed from the plastic containers in approximately 5 minutes.

EXAMPLE 3

Urea-Based Cleaning Composition Containing a Nonionic Surfactant Cleaning Agent A rinse composition for use in the final rinse of a commercial dishwashing machine was prepared as described hereinabove in Example 1, except as noted below.

| INGREDIENT | MIXTURE (wt-%) |
|---|---|
| Ethylene oxide/propylene oxide block copolymer (EO/PO = 35/65; M.W. 2500–2900) | 15.00 |
| Ethylene oxide/propylene oxide/etylene oxide block copolymer (EO/PO = 11/21/11; Pluronic L-44) | 67.13 |
| Hydroxyacetic acid, 70% | 0.10 |
| Acid Blue 182 (Sandolan blue EHRL dye; Sandoz, NC) | 0.03 |
| Soft water | 3.00 |
| Biocide, Kathon CG ICP II (Rohm & Haas; PA) | 0.74 |
| Urea, prilled | 14.00 |

The surfactant, acid, dye, water and biocide comprised a single liquid premix. The urea constituted the only dry feed.

The urea was fed into the first section of the extruder. The liquid premix was split and fed into sections 1 and 4. Sections 1 and 2 were heated to 175° F., exit temperature was 75° F., and exit pressure was 100 psi. The product was filled into polyethylene containers.

The extruded material hardened to a firm block that could be removed from the plastic container in approximately 10 minutes.

EXAMPLE 4

Urea-Based Cleaning Composition Containing a Cationic Surfactant

A detergent composition for use to control odors and soil build-up in floor drains, troughs, pits, and overhead drip and collection pans in the dairy and food processing industries was prepared as described hereinabove in Example 1, except as noted below.

| INGREDIENT | MIXTURE (wt-%) |
|---|---|
| $C_{12}$–$C_{18}$ alkyl dimethylbenzyl ammonium chloride | 42.00 |
| Propylene glycol | 5.00 |
| Stearic diethanolamide | 21.91 |
| Stearic monoethanolamide | 10.97 |
| Urea | 19.65 |

-continued

| INGREDIENT | MIXTURE (wt-%) |
|---|---|
| Morton Blue E dye | 0.02 |
| Silicone defoamer (Dow Corning 544) | 0.45 |

The quaternary ammonium chloride surfactant, propylene glycol, dye, and defoamer formed a single liquid premix. The remaining raw materials formed a dry premix.

The dry premix bas fed into the first section of the extruder. The liquid mix was heated to 160° F. and fed into the fourth section. Sections 1 and 2 were heated to 250° F., exit temperature was 120° F., and exit pressure was 40 psi.

The product formed a material with caulk-like consistency within 5 minutes of existing the extruder.

What is claimed is:

1. A process for preparing a homogeneous, solid block cleaning composition, comprising:

(a) mixing together in a continuous mixing system at high shear to provide a homogeneous mixture, a hardening amount of urea and an effective amount of a cleaning agent without the application of heat to cause melting of the urea in the mixture, the urea in the mixture having a particle size of about 50 to 125 U.S. mesh;

(b) discharging the mixture from the mixing system; and (c) allowing the mixture to harden to the solid composition.

2. The process according to claim 1, wherein the cleaning agent is combined witch an amount and particle size of the urea effective to form a matrix having the cleaning agent and urea distributed substantially evenly throughout.

3. The process according to claim 2, wherein the urea has a particle size of about 8–15 U.S. mesh, and the process includes reducing the particle size of the urea prior to or during mixing step (a).

4. The process according to claim 1, wherein the particle size of the urea is reduced by milling.

5. The process according to claim 1, wherein the mixing temperature in step (a) is about 0.5°–50° C. below the melting point of the urea.

* * * * *

UNITED STATES PATENT AND TRADEMARK OFFICE

CERTIFICATE OF CORRECTION

PATENT NO. : 5,674,831

DATED : October 7, 1997

INVENTOR(S) : Schulz et al.

It is certified that error appears in the above-identified patent and that said Letters Patent is hereby corrected as shown below:

On column 16, line 11, please delete "bas" and substitute therefore --was--

On column 16, line 17, please delete "existing" and substitute therefore --exiting--

Signed and Sealed this

Thirtieth Day of June, 1998

*Attest:*

Bruce Lehman

BRUCE LEHMAN

*Attesting Officer*

*Commissioner of Patents and Trademarks*